US005424612A

United States Patent [19]

Kim

[11] Patent Number: 5,424,612

[45] Date of Patent: Jun. 13, 1995

[54] CATHODE DRIVING CIRCUIT FOR A PLASMA DISPLAY PANEL

[75] Inventor: Sang-cheol Kim, Suwon, Rep. of Korea

[73] Assignee: Samsung Display Devices Co. Ltd., Kyungki, Rep. of Korea

[21] Appl. No.: 295,098

[22] Filed: Aug. 24, 1994

[30] Foreign Application Priority Data

Aug. 25, 1993 [KR] Rep. of Korea ..... 93-16538

[51] Int. Cl.[6] ..... H01J 19/14

[52] U.S. Cl. ..... 315/169.3; 315/169.1; 315/169.2; 345/61

[58] Field of Search ..... 315/169.1, 169.2, 169.3, 315/167; 345/60, 61, 62, 41, 42

[56] References Cited

U.S. PATENT DOCUMENTS 3,842,314 10/1974 Iwakawa et al. ..... 315/169.3

4,888,523 12/1989 Shoji et al. ..... 315/169.3

*Primary Examiner*—Robert J. Pascal

*Assistant Examiner*—David Vu

*Attorney, Agent, or Firm*—Leydig, Voit & Mayer

[57] ABSTRACT

A cathode driving circuit for a plasma display panel includes first, second and third storing means, first, second and third AND gates, a first transistor, a first diode, a bias resistor, a first resistor, a second diode, second and third transistors, and third and fourth diodes. Therefore, the configuration of a cathode driving circuit is simplified.

13 Claims, 6 Drawing Sheets

CATHODE DRIVING CIRCUIT FOR A PLASMA DISPLAY PANEL

BACKGROUND OF THE INVENTION

The present invention relates to a driving circuit for a plasma display panel, and more particularly, to a cathode driving circuit for a plasma display panel.

FIG. 1 shows the structure of a conventional direct current memory type plasma display panel (PDP).

In FIG. 1, the PDP has a front plate 1, a rear plate 2, a plurality of anodes 3 arranged in a stripe form crosswise on the front plate 1, a trigger electrode 4 installed on the whole surface of the rear plate 2, a dielectric 5 covering the whole surface of the trigger electrode 4, a barrier 6 formed in a shape of lattice on the dielectric 5, a plurality of stripe-shaped sustaining anodes 7 formed in one side of the barrier 6 and a plurality of stripe-shaped cathodes 8 formed in the other side of the barrier 6.

FIGS. 2A through 2D show waveforms for driving the conventional direct current memory type PDP. FIG. 2A shows the pulse applied to a data electrode, FIG. 2B shows the pulse applied to the sustaining anode, FIG. 2C shows the pulse applied to the trigger electrode and FIG. 2D shows the pulse applied to the cathode.

The method for driving the PDP as shown in FIG. 1 is hereinafter described using the above mentioned waveforms. The operation of the PDP includes the steps of trigger setting, trigger discharging, primary discharging, sustaining and erasing. The operation of each step is described as follows.

If a trigger voltage $-V_T$ (FIG. 2C) is applied to the trigger electrode 4 and a voltage $V_W$ (FIG. 2A) is applied to the data electrode, the trigger setting occurs to accumulate positive charges on the dielectric 5.

The trigger discharging happens when a voltage $-V_K$ (FIG. 2D) is applied to a first cathode to discharge the positive charges accumulated on the dielectric 5 around the first cathode.

The primary discharging step is performed if a voltage $-V_K$ is applied to the first cathode and data applied to anode 3 exists.

The discharge generated in the primary discharging step is sustained if a voltage $V_{SA}$ (FIG. 2B) is applied to the sustaining anode 7 and a voltage $-V_{SK}$ (FIG. 2D) is applied to cathode 8.

The discharge is eliminated when a voltage $-V_B$ (FIG. 2D) is applied to the cathodes 8.

If the voltage difference applied between two electrodes is greater than a discharge starting voltage, discharging is started. If the voltage difference applied between two electrodes is greater than a discharge sustaining voltage, discharging is sustained. If the voltage difference applied between two electrodes is lower than a discharge sustaining voltage, discharging is eliminated.

In order to operate as described above, the circuits for generating the pulses applied to the respective electrodes as shown in FIGS. 2A through 2D are necessary. Among them, the configuration of the circuit for driving cathodes is described.

FIG. 3 is a cathode driving circuit diagram of a conventional PDP.

In FIG. 3, the circuit includes first through fourth shift registers 10, 20, 30 and 40 for storing and outputting four corresponding data signals D1, D2, D3 and D4 in accordance with four clock signals CK1, CK2, CK3 and CK4, respectively, AND gates 50, 60, 70 and 80 for performing AND-operations by inputting the output signals of the shift registers 10, 20, 30 and 40 and four corresponding enabling signals EN1, EN2, EN3 and EN4, respectively, a PMOS transistor Q1 having a gate electrode which inputs the output signal of the AND gate 50 and a source electrode to which a voltage $-V_B$ is applied, a diode 90 having a cathode electrode connected to the source electrode of the PMOS transistor Q1 and an anode electrode connected to the drain electrode of the PMOS transistor Q1, a diode 130 having a cathode electrode connected to a drain electrode of the PMOS transistor Q1 and an anode electrode connected to an output terminal $K_n$, a NMOS transistor Q2 having a gate electrode which inputs the output signal of the AND gate 60, a drain electrode connected to the cathode electrode of the diode 130 and a source electrode to which a voltage $-V_{SK}$ is applied, a diode 100 having a cathode electrode connected to the source electrode of the NMOS transistor Q2 and an anode electrode connected to the drain electrode of the NMOS transistor Q2, NMOS transistors Q3 and Q4 having gate electrodes which input the output signals of the AND gates 70 and 80, drain electrodes connected to the drain electrode of the PMOS transistor Q1 and source electrodes to which a voltage $-V_K$ is applied, respectively, a diode 110 having a cathode electrode connected to the source electrode of the NMOS transistor Q3 and an anode electrode connected to the drain electrode of the NMOS transistor Q3, and a diode 120 having a cathode electrode connected to the source electrode of the NMOS transistor Q4 and an anode electrode connected to the drain electrode of the NMOS transistor Q4.

FIG. 4 shows the operation of the circuit shown in FIG. 3 and a waveform generated through the output terminal Kn.

The operation of the cathode driving circuit is described as follows with reference to FIGS. 3 and 4.

During a first period (1), the waveform in case the NMOS transistor Q4 is on and the PMOS transistor Q1 and the NMOS transistors Q2 and Q3 are off, is shown and a voltage $-V_K$ is generated.

During a second period (2), the waveform in case the PMOS transistor Q1 is on and the NMOS transistors Q2, Q3 and Q4 are off, is shown and a voltage $-V_B$ is generated.

During a third period (3), the waveform in case the NMOS transistor Q3 is on and the PMOS transistor Q1 and the NMOS transistors Q2 and Q4 are off, is shown and a voltage $-V_K$ is generated.

During a fourth period (4), the waveform in case the NMOS transistor Q2 is on and the PMOS transistor Q1, the NMOS transisters Q3 and Q4 are off, is shown and a voltage $-V_{SK}$ is generated.

However, since the configuration of the conventional cathode driving circuit is complicated, the chip space for its integration occupies much.

SUMMARY OF THE INVENTION

It is an object of the present invention to provide a cathode driving circuit for a plasma display panel, the configuration of which is simple.

It is another object of the present invention to provide a cathode driving circuit for a plasma display panel, which can reduce the chip space for its integration.

To accomplish the above object, the cathode driving circuit for a plasma display panel according to the present invention, comprises: first, second and third storing means for storing and outputting data in response to first, second and third clock signals, respectively; first, second and third AND-operating means for performing AND-operations by inputting the output signals of the first, second and third storing means and first, second and third enabling signals, respectively; a first transistor having a gate electrode which inputs the output signal of the first AND-operating means and a source electrode to which a first voltage is applied; bias resistance means having one end to which a second voltage is applied and the other end being connected to an output terminal; first resistance means having one end connected to the other end of the bias resistance means and the other end being connected to the drain electrode of said first transistor; a diode having an anode electrode and a cathode electrode which are connected to the one end and the other end of the first resistance means, respectively; and second and third transistors having gate electrodes to which the output signals of the second and third AND-operating means are applied, respectively, drain electrodes connected to the output terminal, and source electrodes to which a third voltage is applied.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

The cathode driving circuit of a direct current memory type plasma display panel according to the present invention will be described with reference to the accompanying drawings.

Figure 5:
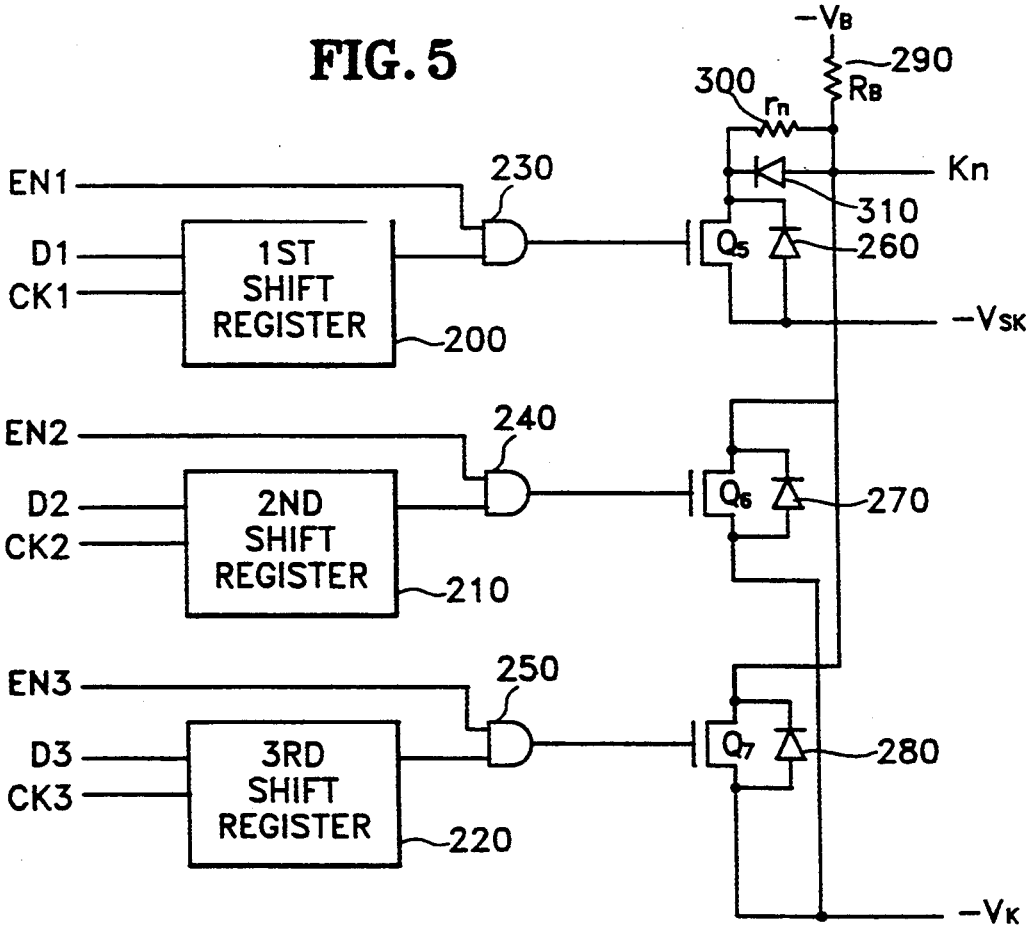
FIG. 5 is a circuit diagram of the cathode driving circuit of a direct current memory type plasma display panel according to the present invention.

FIG. 5 is a circuit diagram of the cathode driving circuit of a direct current memory type plasma display panel according to the present invention.

In FIG. 5, the circuit includes first, second and third shift registers 200, 210 and 220 for storing and outputting data, D1, D2 and D3 in response to first, second and third clock signals, CK1, CK2 and CK3; AND gates 230, 240 and 250 for performing AND-operations by inputting the output signals of the shift registers 200, 210 and 220 and the enabling signals, EN1, EN2 and EN3, respectively; an NMOS transistor Q5 having a gate electrode to which the output signals of the AND gates 230, 240 and 250 are applied and a source electrode to which a voltage $V_{SK}$ is applied; a resistance $R_B$ having one end to which a voltage $-V_B$ is applied and the other end being connected to the output terminal $K_n$; a resistance $r_n$ having one end connected to the other end of resistance $R_B$ and the other end being connected to the drain electrode of the NMOS transistor $Q_5$; a diode 310 connected across the resistance $r_n$, a diode 260 having an anode electrode connected to the source electrode of the NMOS transistor $Q_5$ and a cathode electrode connected to the drain electrode of the NMOS transistor $Q_5$; an NMOS transistor $Q_6$ having a gate electrode to which the output signal of the AND gate 240 is applied, a drain electrode connected to the output terminal $K_n$ and a source electrode to which a voltage $-V_K$ is applied; a diode 270 having an anode electrode connected to the source electrode of the NMOS transistor $Q_6$ and a cathode electrode connected to the drain electrode of the NMOS transistor $Q_6$; an NMOS transistor $Q_7$ having a gate electrode to which the output signal of the AND gate 250 is applied, a drain electrode connected to the output terminal $K_n$ and a source electrode to which a voltage $-V_K$ is applied; and a diode 280 having an anode electrode connected to the source electrode of the NMOS transistor $Q_7$ and a cathode electrode connected to the drain electrode of the NMOS transistor $Q_7$.

In the structure as described above, since the trigger discharging or writing period of one of the cathodes should not be overlapped with that of another cathode, shift registers 210 and 220 and NMOS transistors $Q_6$ and $Q_7$ are installed separately. If the outputs of AND gates 240 and 250 are fed to an OR gate, it is possible to construct the circuit using a single NMOS transistor.

Also, since there are diodes 260, 270 and 280 between the drain electrodes and the source electrodes of the NMOS transistors $Q_s$, $Q_6$ and $Q_7$, if the drain electrodes of the NMOS transistor $Q_5$ and the NMOS transistors $Q_6$ and $Q_7$ are connected without diode 310 and resistance 300, a short occurs between voltages $-V_{SK}$ and $-V_K$ when NMOS transistors $Q_6$ and $Q_7$ are turned on.

FIGS. 6A & 6B, 7A & 7B, 8A & 8B and 9A & 9B are simplified circuit diagrams of the circuit shown in FIG. 5 at the time of the respective operations and graphs showing the change of the output voltages over time. The simplified circuit diagrams show circuits with respect to transistors $Q_5$ and $Q_6$.

For the voltage levels of the respective cathode waveforms, assuming that the voltage of the trigger discharge level and writing level is designated as $-V_K$, the sustaining voltage is designated as $-V_{SK}$ and the squelch voltage is designated as $-V_B$, then we can say that $-V_K \leqq V_{SK} \leqq V_B$.

Figure 6A:
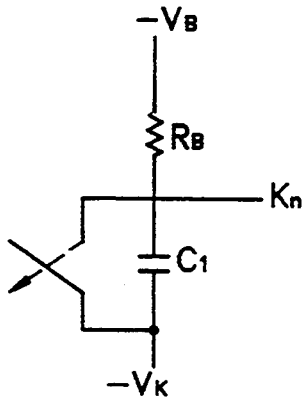
FIGS. 6A & 6B, 7A & 7B, 8A & 8B and 9A & 9B are simplified circuit diagrams of the circuit shown in FIG. 5.
Figure 6B:
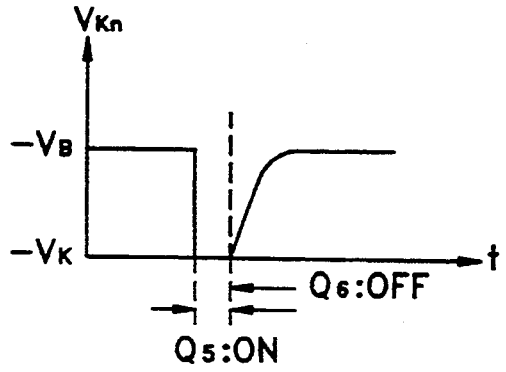

FIGS. 6A and 6B show a delay phenomenon in case there is neither resistance rn nor diode 310, which can be simplified if transistor $Q_5$ is turned on and then is turned off.

Assuming that a capacitor between the drain and source of transistor $Q_6$ is $C_1$, when transistor $Q_2$ is turned off (from the "on" state), the delay of the output voltage $V_{Kn}$ is computed as follows.

$$V_{Kn} = -V_B(1 - e^{\frac{-t}{RBC_1}}) - V_K e^{\frac{-t}{RBC_1}} \quad (1)$$

The above equation (1) is expressed in a graph shown in FIG. 6B. It is understood from FIG. 6B that the output voltage $V_{Kn}$ maintains the voltage $-V_B$ when the transistor is turned on and the output voltage $V_{Kn}$ maintains the voltage $-V_K$ when the transistor is turned off. Then, the output voltage $V_{Kn}$ is delayed as expressed in the equation (1), to rise to a voltage $-V_B$.

Figure 7A:
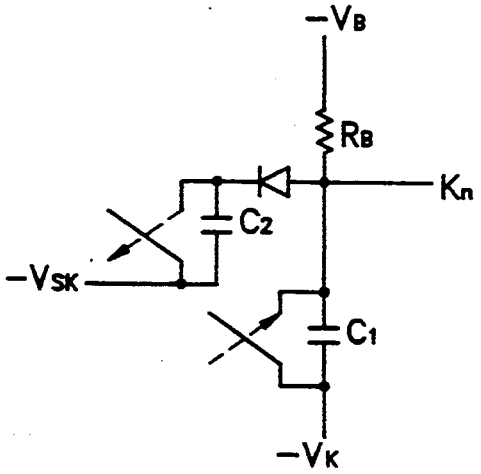
Figure 7B:
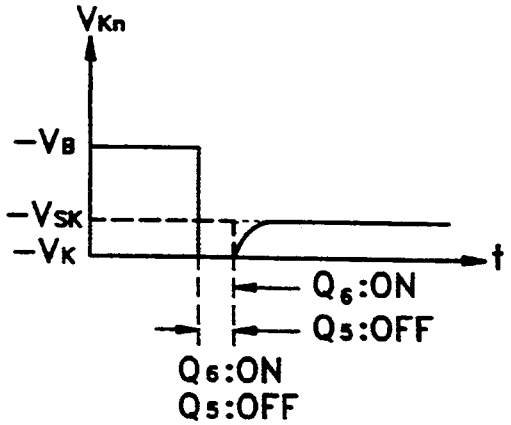

FIGS. 7A and 7B demonstrate a delay phenomenon in case there is no resistance $r_n$. Here, FIG. 7A is the simplified circuit.

When transistor $Q_6$ is on, transistor $Q_5$ is turned on from off state, and transistor $Q_6$ is turned off, assuming that a capacitor between the drain and source of transistor $Q_6$ is $C_1$ and that a capacitor between the drain and source of transistor $Q_5$ is $C_2$, the delay of the output voltage $V_{Kn}$ is computed as follows.

$$V_{Kn} = -V_B(1 - e^{\frac{-t}{RBC2}}) - V_K e^{\frac{t}{RBC1}} \quad (2)$$

It is understood from FIG. 7B that the output voltage $V_{Kn}$ maintains the voltage $-V_B$ and then becomes the voltage $-V_K$ when one of the transistors $Q_6$ and $Q_7$ is turned on and the transistor $Q_5$ is turned off. When the transistor $Q_5$ is turned on and one of the transistors $Q_6$ and $Q_7$ is turned off, the output voltage $V_{Kn}$ is delayed as expressed in the equation (2), to rise to a voltage $-V_{SK}$.

As a result, as shown in FIGS. 6B and 7B, if there is no resistance $r_n$, a considerable delay occurs due to the resistance RB generated when the output terminal $K_n$ makes a voltage transition from $-V_K$ to $-V_B$ and from $-V_K$ to $-V_{SK}$.

FIGS. 8A & 8B and 9A & 9B show delay characteristics in case the resistance $r_n$ is connected.

Figure 8A:
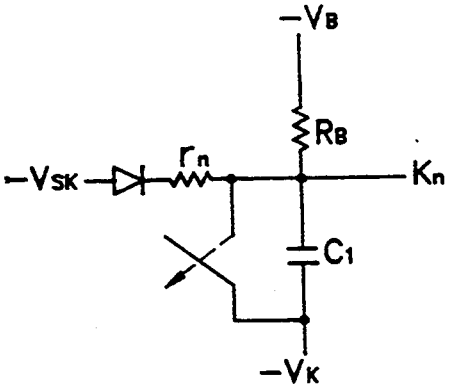
Figure 8B:
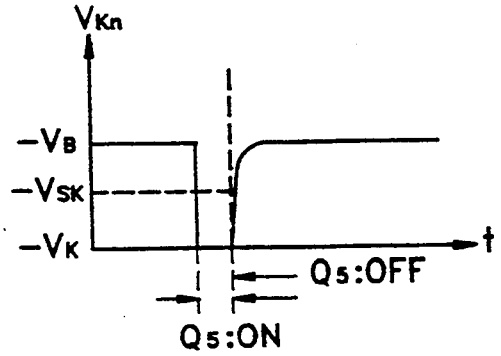

First, FIGS. 8A and 8B explain a delay phenomenon in case resistance $r_n$ and diode 310 is directly connected and show the case of transistor $Q_6$ being turned on and then turned off.

In FIG. 8B, assuming that a capacitor between the drain and source of transistor $Q_6$ is $C_1$, the delay of the output voltage $V_{Kn}$ is computed as $$V_{Kn} = -V_B(1 - e^{\frac{-t}{RBC1}}) - V_K e^{\frac{-t}{RBC1}} \quad (3)$$

when the inequality $-V_{SK} \leqq V_{Kn} \leqq V_B$ is true, but given a $V_{Kn}$ value such that $-V_K \leqq V_{Kn} \leqq V_{SK}$, then $V_{Kn}$ is computed thus:

$$V_{Kn} = -V_{SK}(1 - e^{\frac{-t}{rnC1}}) - V_K e^{\frac{-t}{rnC1}} \quad (3')$$

The above equation (3') indicates the change from voltage $-V_K$ to $-V_{SK}$ when transistor $Q_6$ is turned on and then turned off, and the equation (3) indicates the change from voltage $-V_{SK}$ to $-V_B$.

It is understood from FIG. 8B that the output voltage $V_{Kn}$ maintains the voltage $-V_B$ and then falls to the voltage $-V_K$ when the transistor $Q_5$ is turned on. When the transistor $Q_5$ is turned off, the output voltage $V_{Kn}$ is delayed as shown in the above equation (3) to rise to the voltage $-V_B$.

Figure 9A:
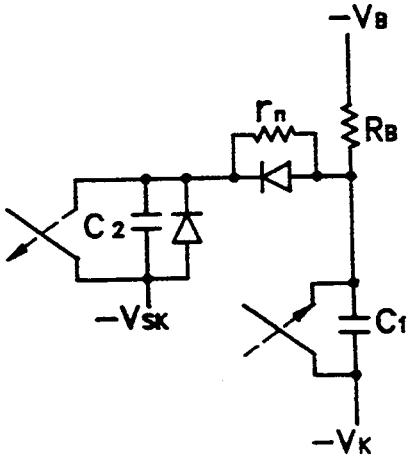
Figure 9B:
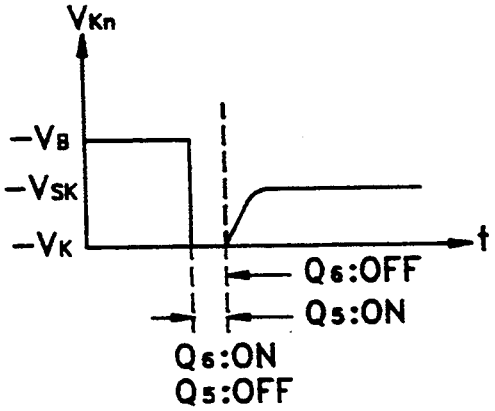

FIGS. 9A and 9B explain a delay phenomenon in case resistance $r_n$ and diode 310 are parallel connected. When transistor $Q_6$ being on is turned off, and transistor $Q_5$ being off is turned on, respectively, assuming that capacitors between each drain and source of transistors $Q_5$ and $Q_6$ are $C_1$ and $C_2$, the delay of the output voltage $V_{Kn}$ is computed as follows.

$$V_{Kn} = -V_{SK}(1 - e^{\frac{-t}{rnC2}}) - V_K e^{\frac{-t}{rnC1}} \quad (4)$$

It is understood from FIG. 9B that the output voltage $V_{Kn}$ maintains the voltage $-V_B$ and then falls to the voltage $-V_K$ when one of the transistors $Q_6$ and $Q_7$ is turned on and the transistor $Q_5$ is turned off. When one of the transistors $Q_6$ and $Q_7$ is turned off and the transistor $Q_5$ is turned off, the output voltage $V_{Kn}$ is delayed as shown in the above equation (4) to rise to the voltage $-V_{SK}$.

Therefore, as understood by the above explanation, in the case of FIG. 9B, the delay is the least and the waveform of cathode driving circuit can be generated.

Accordingly, the present invention constitutes the circuit so that resistance $r_n$ and diode 310 are parallel connected.

If the transistor $Q_5$ is turned on, the discharging current flows through the transistor $Q_s$. However, since most of current flows through the diode 310, the power amount consumed at the resistance $r_n$ is small. Also, when only one of the transistors $Q_6$ and $Q_7$ is turned on, since the current flows from the voltage $-V_{SK}$ to the voltage $-V_K$ through the resistance $r_n$, the power amount consumed at the resistance $r_n$ is small.

Figure 1:
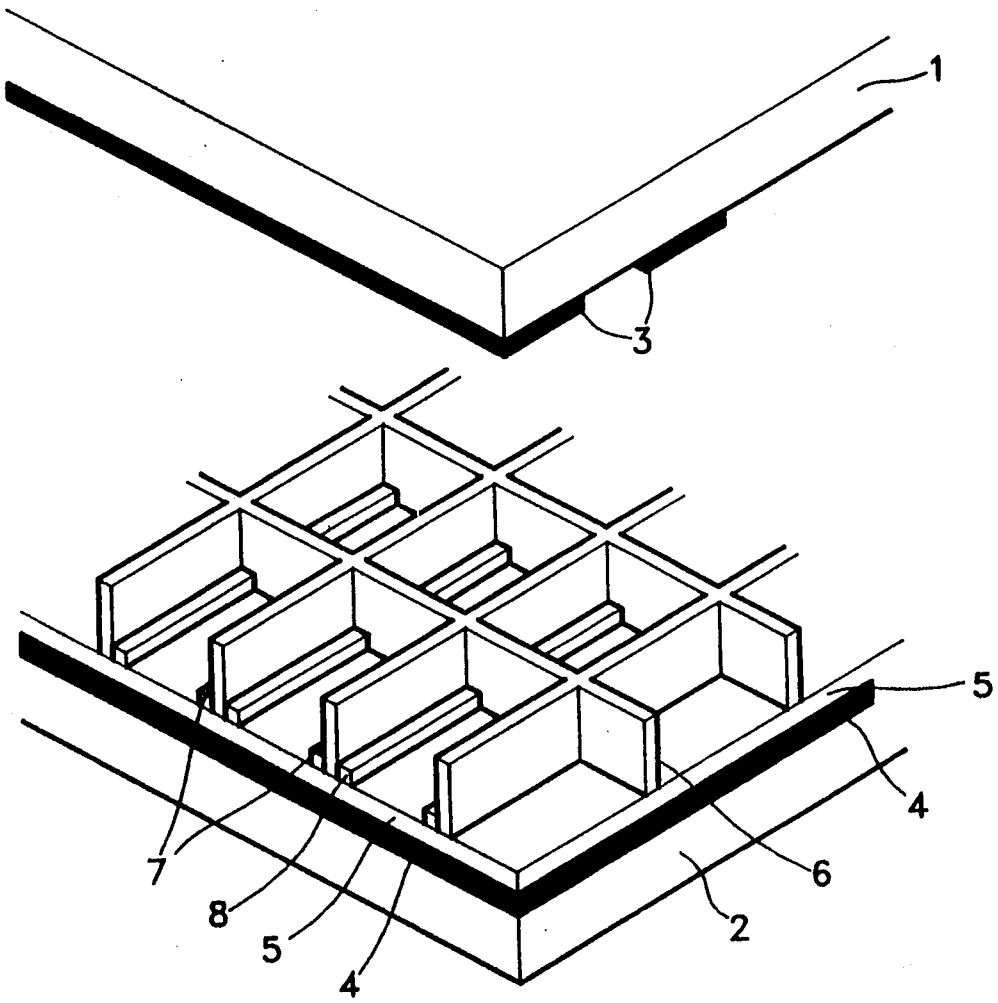
FIG. 1 (PRIOR ART)
FIG. 1 shows the structure of a conventional direct current type memory plasma display panel (PDP).
Figures 2A, 2B, 2C, 2D:
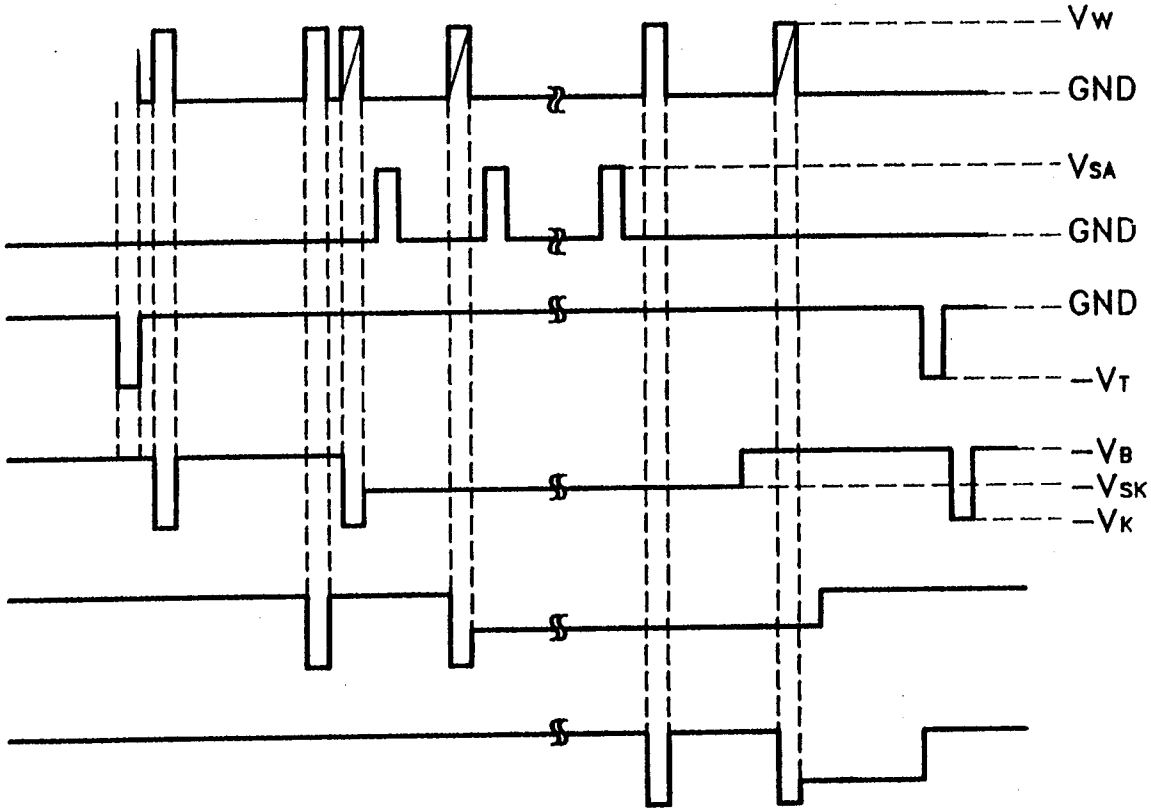
FIG. 2A (PRIOR ART)
FIG. 2B (PRIOR ART)
FIG. 2C (PRIOR ART)
FIG. 2D (PRIOR ART)
FIGS. 2A through 2D, show waveforms for driving the conventional direct current type memory PDP.
Figure 3:
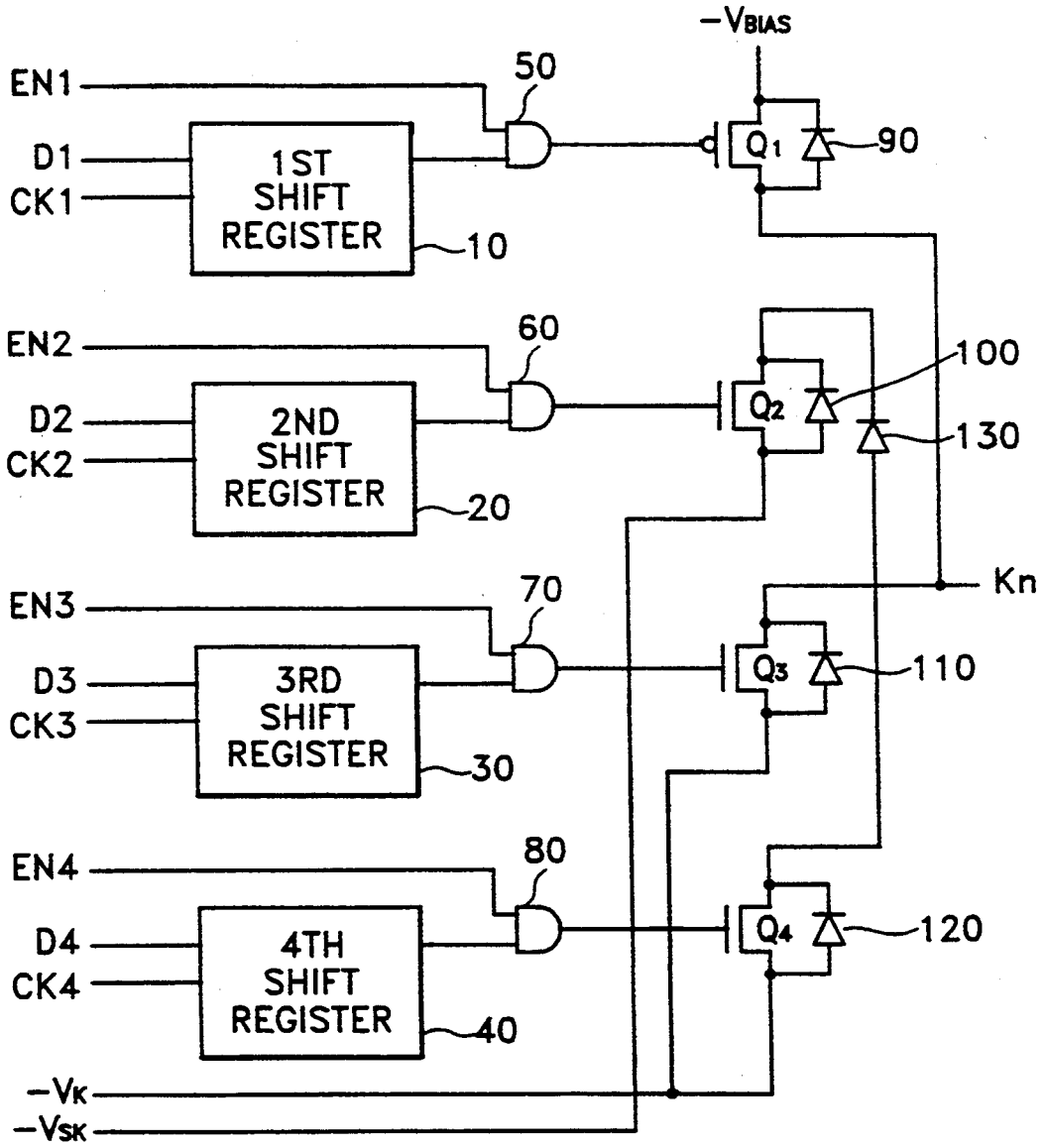
FIG. 3 (PRIOR ART)
FIG. 3 is a cathode driving circuit diagram of a conventional direct current type memory PDP.
Figure 4:
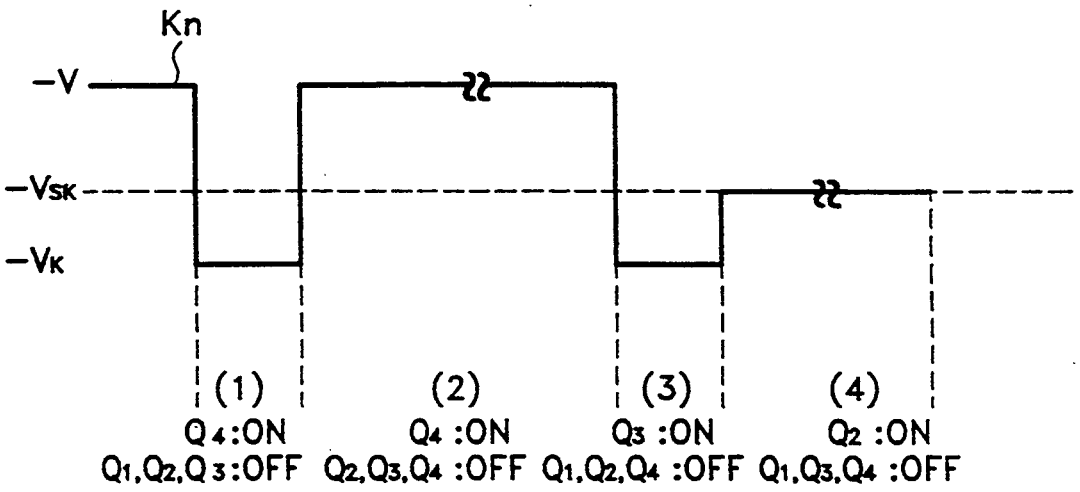
FIG. 4 (PRIOR ART)
FIG. 4 is a waveform explaining the operation of the circuit shown in FIG. 3.

In other words, the cathode driving circuit of the plasma display panel according to the present invention replaces the source driving transistor $Q_1$ as shown in FIG. 3 with a resistance $R_B$ as shown in FIG. 5 and thereby reduces the cost for a driving circuit.

The delay due to the resistance $R_B$ lessens the delay of the output signal by inserting the resistance $r_n$ as shown in FIG. 5.

Therefore, since the configuration of the cathode driving circuit of the plasma display panel according to the present invention is simplified comparing with a conventional circuit, the chip space for its integration can be decreased.

What is claimed is:

1. A cathode driving circuit for a plasma display panel comprising:

first, second and third storing means for storing and outputting data in response to first, second and third clock signals, respectively;

first, second and third AND-operating means for performing AND-operations by inputting the output signals of said first, second and third storing means and first, second and third enabling signals, respectively;

a first transistor having a gate electrode which inputs the output signal of said first AND-operating means and a source electrode to which a first voltage is applied;

bias resistance means having one end to which a second voltage is applied and the other end being connected to an output terminal;

first resistance means having one end connected to the other end of said bias resistance means and the other end being connected to the drain electrode of said first transistor;

a diode having an anode electrode and a cathode electrode which are connected to said one end and the other end of said first resistance means, respectively; and second and third transistors having gate electrodes to which the output signals of the second and third AND-operating means are applied, respectively, drain electrodes connected to said output terminal, and source electrodes to which a third voltage is applied.

2. A cathode driving circuit for a plasma display panel as claimed in claim 1, wherein said first voltage is higher than said second voltage.

3. A cathode driving circuit for a plasma display panel as claimed in claim 2, wherein said second voltage is higher than said third voltage.

4. A cathode driving circuit for a plasma display panel in the driving circuit for a plasma display panel having a plurality of anodes, a plurality of cathodes, a trigger electrode and a sustaining electrode, wherein said driving circuit for driving said plurality of cathodes, comprises:

first, second and third storing means for storing and outputting data in response to first, second and third clock signals, respectively;

first, second and third AND-operating means for performing AND-operations by inputting the output signals of said first, second and third storing means and first, second and third enabling signals, respectively;

a first transistor having a gate electrode which inputs the output signal of said first AND-operating means and a source electrode to which a first voltage is applied;

bias resistance means having one end to which a second voltage is applied and the other end being connected to an output terminal;

first resistance means having one end connected to the other end of said bias resistance means and the other end being connected to the drain electrode of said first transistor;

a diode having an anode electrode and a cathode electrode which are connected to said one end and the other end of said first resistance means, respectively; and second and third transistors having gate electrodes to which the output signals of the second and third AND-operating means are applied, respectively, drain electrodes connected to said output terminal, and source electrodes to which a third voltage is applied.

5. A cathode driving circuit for a plasma display panel as claimed in claim 4, wherein said first voltage is higher than said second voltage.

6. A cathode driving circuit for a plasma display panel as claimed in claim 5, wherein said second voltage is higher than said third voltage.

7. A cathode driving circuit for a plasma display panel comprising:

an output terminal;

a first circuit storing first data and outputting the first data on a first output responsive to a first clock signal and a first enable signal;

a second circuit storing second data and outputting the second data on a second output responsive to a second clock signal and a second enable signal;

a third circuit storing third data and outputting the third data on a third output responsive to a third clock signal and a third enable signal;

a first transistor having a gate connected to the first output, a source to which a first voltage is applied, and a drain;

a first resistance circuit having a first terminal to which a second voltage is applied and a second terminal connected to the output terminal;

a second resistance circuit having a first terminal connected the drain of the first transistor and a second terminal connected to the output terminal;

a first diode having a cathode connected to the drain of the first transistor and an anode connected to the output terminal;

a second transistor having a gate connected to the second output, a source connected to a third voltage, and a drain connected to the output terminal;

a third transistor having a gate connected to the third output, a source connected to the third voltage, and a drain connected to the output terminal.

8. The cathode driving circuit as recited in claim 7 including second and third diodes, the second diode having a cathode connected to the drain of the first transistor and an anode connected to the source of the first transistor, and the third diode having a cathode connected to the drain of the second transistor and an anode connected to the source of the second transistor.

9. The cathode driving circuit as recited in claim 7 wherein the first voltage is higher than the second voltage.

10. The cathode driving circuit as recited in claim 9 the second voltage is higher than the third voltage.

11. The cathode driving circuit as recited in claim 10 wherein the second voltage is a bias voltage.

12. The cathode driving circuit as recited in claim 7 wherein the first resistance circuit is a first resistor and the second resistance circuit is a second resistor.

13. The cathode driving circuit as recited in claim 7 wherein the output terminal drives a plurality of cathodes.

* * * * *